US011175039B2

(12) United States Patent
Lochschmied et al.

(10) Patent No.: US 11,175,039 B2
(45) Date of Patent: Nov. 16, 2021

(54) REGULATING TURBULENT FLOWS

(71) Applicant: Siemens Aktiengesellschaft, Munich (DE)

(72) Inventors: Rainer Lochschmied, Rheinstetten-Forchheim (DE); Mike Schmanau, Malsch (DE); Bernd Schmiederer, Karlsruhe (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 612 days.

(21) Appl. No.: 15/722,129

(22) Filed: Oct. 2, 2017

(65) Prior Publication Data

US 2018/0094809 A1 Apr. 5, 2018

(30) Foreign Application Priority Data

Sep. 30, 2016 (EP) ..... 16191924

(51) Int. Cl.
*F23N 1/02* (2006.01)
*F23D 14/60* (2006.01)
*F23N 5/18* (2006.01)

(52) U.S. Cl.
CPC ..... *F23N 1/025* (2013.01); *F23D 14/60* (2013.01); *F23N 1/027* (2013.01); *F23N 5/18* (2013.01);
(Continued)

(58) Field of Classification Search
CPC ..... F23N 2023/14; F23N 2023/12; F23N 2033/08; F23N 2025/06; F23N 2025/181;
(Continued)

(56) References Cited

U.S. PATENT DOCUMENTS 3,723,047 A * 3/1973 Livois ..... F23N 5/003 431/76
4,717,071 A * 1/1988 Capone ..... F23N 1/027 236/15 E
(Continued)

FOREIGN PATENT DOCUMENTS

CN 1509391 A 6/2004 ..... F04D 29/42
CN 101432572 A 5/2009 ..... F23B 50/06
(Continued)

OTHER PUBLICATIONS

U.S. Non-Final Office Action, U.S. Appl. No. 15/722,192, 13 pages, dated Sep. 5, 2018.
(Continued)

*Primary Examiner* — Alfred Basichas
(74) *Attorney, Agent, or Firm* — Slayden Grubert Beard PLLC

(57) ABSTRACT

The present disclosure deals with the regulation of fluid flows in the presence of turbulence. The teachings thereof may be embodied in regulating a fluid in a combustion device. For example, a method for regulating a burner device may include: requesting a flow of a fluid through a feed duct; assigning the requested flow to a setting of a first actuator; transmitting a first signal to set the first actuator; generating a mass flow signal representing an actual flow through the side duct; correlating the second signal to an actual value of the flow through the side duct; correlating the requested flow through the feed duct to a required flow through the side duct; generating a regulation signal with the regulator for the second actuator as a function of the actual value of the flow through the side duct and the requested value of the flow through the side duct; and transmitting the generated regulation signal to the second actuator.

15 Claims, 6 Drawing Sheets

(52) U.S. Cl.
CPC .... *F23N 2005/181* (2013.01); *F23N 2223/12* (2020.01); *F23N 2223/14* (2020.01); *F23N 2225/06* (2020.01); *F23N 2233/08* (2020.01)

(58) Field of Classification Search
CPC .... F23N 5/18; F23N 2035/10; F23N 2035/06; F23N 1/022; F23N 1/02; F23N 1/025; F23N 1/027; F23N 2223/12; F23N 2225/06; F23N 2233/08; F23N 2223/14; F23N 2005/181; F23D 14/60
USPC ..... 431/76, 12, 18, 354, 89
See application file for complete search history.

(56) References Cited

U.S. PATENT DOCUMENTS

| | | | | |
|---|---|---|---|---|
| 4,717,091 | A * | 1/1988 | Schoettle | G11B 23/08721 242/345.2 |
| 4,930,454 | A * | 6/1990 | Latty | C10L 1/328 122/28 |
| 5,037,291 | A * | 8/1991 | Clark | F23N 1/022 431/12 |
| 5,997,280 | A * | 12/1999 | Welz, Jr. | F23N 1/022 431/31 |
| 6,011,371 | A * | 1/2000 | Brocklin | G06F 1/206 318/268 |
| 6,019,593 | A * | 2/2000 | Lewandowski | F23D 14/36 431/12 |
| 6,939,127 | B2 | 9/2005 | Goebel | 431/12 |
| 8,281,584 | B2 | 10/2012 | Weber | 60/524 |
| 8,303,297 | B2 * | 11/2012 | Tompkins | F23N 1/022 431/12 |
| 9,677,765 | B2 | 6/2017 | Metz et al. | |
| 2001/0051321 | A1 * | 12/2001 | Fontaine | F23N 1/022 431/12 |
| 2009/0111065 | A1 | 4/2009 | Tompkins et al. | 431/12 |
| 2010/0112500 | A1 * | 5/2010 | Maiello | F23N 1/022 431/76 |
| 2013/0045077 | A1 * | 2/2013 | Metz | F23N 1/022 415/1 |
| 2013/0302738 | A1 | 11/2013 | Rennie et al. | 431/12 |
| 2014/0080075 | A1 * | 3/2014 | Young | F23N 1/022 431/76 |
| 2014/0261111 | A1 | 9/2014 | Cantú et al. | 110/188 |
| 2015/0113998 | A1 | 4/2015 | Tatsumi et al. | 60/776 |
| 2016/0076767 | A1 | 3/2016 | Super et al. | 431/76 |
| 2017/0254536 | A1 | 9/2017 | Super et al. | |

FOREIGN PATENT DOCUMENTS

| | | | | |
|---|---|---|---|---|
| CN | 202904382 | U | 4/2013 | F23B 80/02 |
| CN | 104718438 | A | 6/2015 | G01F 1/42 |
| DE | 3703934 | A1 | 8/1987 | F23N 1/02 |
| DE | 4337703 | C1 | 3/1995 | F23N 1/02 |
| DE | 19501749 | A1 | 7/1996 | F23D 14/60 |
| DE | 102004055715 | B4 | 1/2006 | F23D 14/60 |
| DE | 102010010952 | A1 | 9/2011 | F23D 14/60 |
| EP | 1243857 | A1 | 9/2002 | F04D 29/42 |
| EP | 1236957 | B1 | 11/2006 | F23L 17/00 |
| EP | 2556303 | B1 | 2/2016 | F23N 1/02 |
| FR | 2723630 | A1 | 2/1996 | F23N 1/02 |
| GB | 1571906 | A | 7/1980 | F23N 1/02 |
| JP | 3031856 | B2 | 4/2000 | F23N 1/02 |
| RU | 2067259 | C1 | 9/1996 | F23N 5/08 |
| RU | 2141604 | C1 | 11/1999 | F23N 5/00 |
| RU | 2169311 | C1 | 6/2001 | F23C 15/00 |
| RU | 2349838 | C2 | 3/2009 | F23N 1/02 |
| WO | 2014/045104 | A1 | 3/2014 | G01F 1/42 |

OTHER PUBLICATIONS

Chinese Office Action, Application No. 201710914124.4, 5 pages, dated Apr. 24, 2019.
Russian Office Action, Application No. 2017133734/06, 12 pages, dated Aug. 14, 2018.
U.S. Non-Final Office Action, U.S. Appl. No. 15/722,246, 15 pages, dated Aug. 23, 2018.
Russian Office Action, Application No. 2017133736/06, 12 pages, dated Sep. 27, 2018.
U.S. Final Office Action, U.S. Appl. No. 15/722,246, 17 pages, dated Dec. 5, 2018.
Russian Office Action, Application No. 2017133736/06, 6 pages, dated May 22, 2018.

* cited by examiner

REGULATING TURBULENT FLOWS

CROSS-REFERENCE TO RELATED APPLICATIONS

This application claims priority to EP Application No. 16191924.6 filed Sep. 30, 2016, the contents of which are hereby incorporated by reference in their entirety.

TECHNICAL FIELD

The present disclosure deals with the regulation of fluid flows in the presence of turbulence. The teachings thereof may be embodied in regulating a fluid in a combustion device.

BACKGROUND

Changes of air temperature and/or air pressure cause fluctuations of the air/fuel ratio λ to occur. Combustion devices are therefore typically set with an air surplus to avoid unhygienic combustion, e.g., incomplete combustion resulting from lack of oxygen. The disadvantage of setting combustion devices to an air surplus is a reduced level of efficiency of the system.

Typically, rotational speed sensors and air pressure switches are used for measuring the throughput of air. Rotational speed sensors may not be sensitive to fluctuations in air temperature and air pressure. Air pressure switches monitor the air accurately at a single specific pressure. Using a number of switches allows air pressure to be monitored at the same number of pressures. Despite this, an adjustment in the entire operating range of the combustion device is as yet barely possible.

The occurrence of turbulence makes the problem even more difficult, since the signal of a flow sensor is greatly influenced by its installed position in the middle of a turbulent flow. As well as this, the turbulence causes the measurement signal to be very noisy.

European patent EP1236957B1 describes the adaptation of a burner-operated heating device to an air exhaust system. EP1236957B1 discloses a pressure sensor/air mass sensor 28, which is arranged in the air feed 14 or exhaust gas venting system of a heating device. A regulating device 30 regulates a fan 26, starting from the signal of the sensor 28. To adapt the instantaneous air volume flow to a required air volume flow, an operating characteristic curve 40 is stored. To improve the regulation behavior with large differences in temperature and with respect to emergency operating characteristics a temperature sensor 35 is provided.

European patent EP2556303B1 describes a pneumatic composite having mass balancing. EP2556303B1 discloses a venturi nozzle 5, which creates a vacuum, with a mass flow sensor 6 in an additional duct 7. An open-loop or closed-loop controller 9 regulates the speed of a fan 1 as a function of the signal of the sensor 6.

German patent DE102004055715B4 describes setting of the air/fuel ratio of a firing device. According to DE102004055715B4 an air mass flow $m_L$ will be set to an increased value so that a hygienic combustion occurs.

SUMMARY

The teachings of the present disclosure may be employed to improve the regulation of flows in combustion devices, especially in the presence of turbulence. For example, a method for regulating a burner device with a mass flow sensor (13) in a side duct (28) of a feed duct (11) of the burner device, a regulator (37), at least one first actuator (4, 3) acting on the feed duct (11) and at least one second actuator (3, 4) acting on the feed duct (11), wherein the at least one first actuator (4, 3) and the at least one second actuator (3, 4) are embodied for receiving signals, may include: requesting a throughflow (5) of a fluid through the feed duct (11), assigning the requested throughflow (5) through the feed duct (11) to a setting of the at least one first actuator (4, 3), generation of a first signal (23, 22) for the at least one first actuator (4, 3), wherein the generated first signal (23, 22) is a function of the setting of the at least one first actuator (4, 3) assigned to the requested throughflow (5) through the feed duct (11), output of the generated first signal (23, 22) to the at least one first actuator (4, 3), generation of a second signal (21) by the mass flow sensor (13), wherein the second signal (21) is a function of a throughflow (15) through the side duct (28), processing of the second signal (21) generated by the mass flow sensor (13) to an actual value of the throughflow (15) through the side duct (28), processing of the requested throughflow (5) through the feed duct (11) to a required value (32) of the throughflow (15) through the side duct (28), generation of a regulation signal (22, 23) by the regulator (37) for the at least one second actuator (3, 4) as a function of the actual value of the throughflow through the side duct (28) and as a function of the required value (32) of the throughflow (15) through the side duct (28), and output of the generated regulation signal (22, 23) to the at least one second actuator (3, 4).

In some embodiments, processing of the requested throughflow (5) through the feed duct (11) to a required value (32) of the throughflow (15) through the side duct (28) comprises a reversibly unique assignment of the requested throughflow (5) through the feed duct (11) to a required value (32) of the throughflow (15) through the side duct (28).

In some embodiments, a regulation signal is generated for the at least one second actuator (3, 4) on the basis of a proportional-integral regulator (37) or on the basis of a proportional-integral-derivative regulator (37).

In some embodiments, the at least one second actuator of the burner device comprises a fan (3) with a rotational speed that can be set, wherein the fan (3) with a rotational speed that can be set comprises a drive, and wherein the fan (3) is arranged in the feed duct (11) of the burner device.

In some embodiments, the generated regulation signal (22, 23) to the at least one second actuator (3, 4) is a pulse-width-modulated signal or is a converter signal with a frequency that corresponds to the rotational speed of at least one second actuator (3, 4) embodied as a fan (3).

In some embodiments, the at least one first actuator of the burner device comprises a flap (4) with motorized adjustment with a drive and the flap (4) with motorized adjustment is arranged in the feed duct (11) of the burner device.

In some embodiments, the processing of the second signal (21) generated by the mass flow sensor (13) comprises a filtering of the second signal (21) generated by the mass flow sensor (13).

In some embodiments, the burner device additionally comprises a fuel feed duct (38) with at least one safety shut-off valve (7-8) for closing off the fuel feed duct (38), wherein the at least one safety shut-off valve (7-8) is embodied to receive a signal (24-25) to switch off the burner device and as a response to receiving a signal (24-25) for switching off the burner device to close the burner feed duct (38), the method additionally comprising the steps: comparing the generated regulation signal (22-23) with an upper threshold value and/or with a lower threshold value, generating a signal (24-25) for switching off the burner device, if the generated regulation signal (22-23) lies above the upper threshold value or below the lower threshold value, and output of the generated signal (24-25) for switching off the burner device to the at least one safety shut-off valve (7-8), if the generated regulator signal (22-23) lies above the upper threshold value and/or below the lower threshold value.

In some embodiments, the burner device additionally comprises a fuel feed duct (38) with at least one safety shut-off valve (7-8) for closing off the fuel feed duct (38), wherein the at least one safety shut-off valve (7-8) is embodied to receive a signal (24-25) to switch off the burner device and as a response to receiving a signal (24-25) for switching off the burner device to close the burner feed duct (38), the method additionally comprising the steps: comparing the actual value of the throughflow (15) through the side duct (28) with an upper threshold value and/or with a lower threshold value, generating a signal (24-25) for switching off the burner device, if the actual value of the throughflow (15) through the side duct (28) lies above the upper threshold value and/or below the lower threshold value, output of the generated signal (24-25) for switching off the burner device to the at least one safety shut-off valve (7-8), if the actual value of the throughflow (15) through the side duct (28) lies above the upper threshold value and/or below the lower threshold value.

In some embodiments, the requested throughflow (5) through the feed duct (11) is assigned to a setting of the at least one first actuator (4, 3) on the basis of a predetermined table, in which values of the requested throughflow through the feed duct (11) are assigned to settings of the at least one first actuator (4, 3).

In some embodiments, the burner device additionally comprises a fuel feed duct (38) and at least one fuel actuator (9) acting on the fuel feed duct (38) and the fuel actuator (9) is embodied to receive fuel signals (26), the method additionally comprising the steps: requesting a throughflow (6) of a fuel through the fuel feed duct (38), assigning the throughflow (6) of a fuel through the fuel feed duct (38) to a setting of the at least one fuel actuator (9), wherein the throughflow (6) of a fuel through the fuel feed duct 38 is assigned to a setting of the at least one fuel actuator (9) on the basis of a table, in which values of the requested throughflow (6) of a fuel through the fuel feed duct (38) are assigned to values of the settings of the at least one fuel actuator (9), generation of a fuel signal (26) for the at least one fuel actuator (9), wherein the generated fuel signal (26) is a function of the setting of the at least one fuel actuator (9) assigned to the requested throughflow (6) of a fuel through the fuel feed duct (38), and output of the generated fuel signal (26) to the at least one fuel actuator (9) and setting of the at least one fuel actuator (9) in accordance with the fuel signal (26) output.

In some embodiments, the method additionally comprises the step: assignment of a throughflow (6) of a fuel through the fuel feed duct (38) to a throughflow (5) of a fluid through the feed duct (11) on the basis of a constant factor between the throughflow (6) of a fuel through the fuel feed duct (38) and a throughflow (5) of a fluid through the feed duct (11).

In some embodiments, the burner device additionally comprises an exhaust gas duct (30) with a lambda probe (40) in the exhaust gas duct (30) to enable λ regulation by the control device (16) based on signals of the probe (40) in the exhaust gas duct (30), the method additionally comprising the steps: generation of a signal (42) by the probe (40) in the exhaust gas duct (30), transfer of the signal (42) from the probe (40) in the exhaust gas duct (30) to the controller (16), determination of a variable factor between the throughflow of a fuel (6) through the fuel feed duct (38) and the throughflow (5) of a fluid through the feed duct (11) as a function of the transferred signal (42), and assignment of a throughflow (6) of a fuel through the fuel feed duct (38) to a throughflow (5) of a fluid through the feed duct (11) on the basis of the variable factor determined.

In some embodiments, the method additionally comprises: determining a power of the burner device on the basis of the required value (32) of the regulator (37) and/or on the basis of the value of the requested throughflow (5) through the feed duct (11).

Some embodiments include non-volatile computer-readable storage media that stores a set of instructions to be carried out by the at least one processor, which, when it is carried out by the processor, carries out the method with the steps as described above.

BRIEF DESCRIPTION OF THE DRAWINGS

Various details become accessible to the person skilled in the art on the basis of the following detailed description. The individual forms of embodiment are not restrictive in this description. The drawings, which are enclosed with the description, can be described as follows.

DETAILED DESCRIPTION

Figure 1:
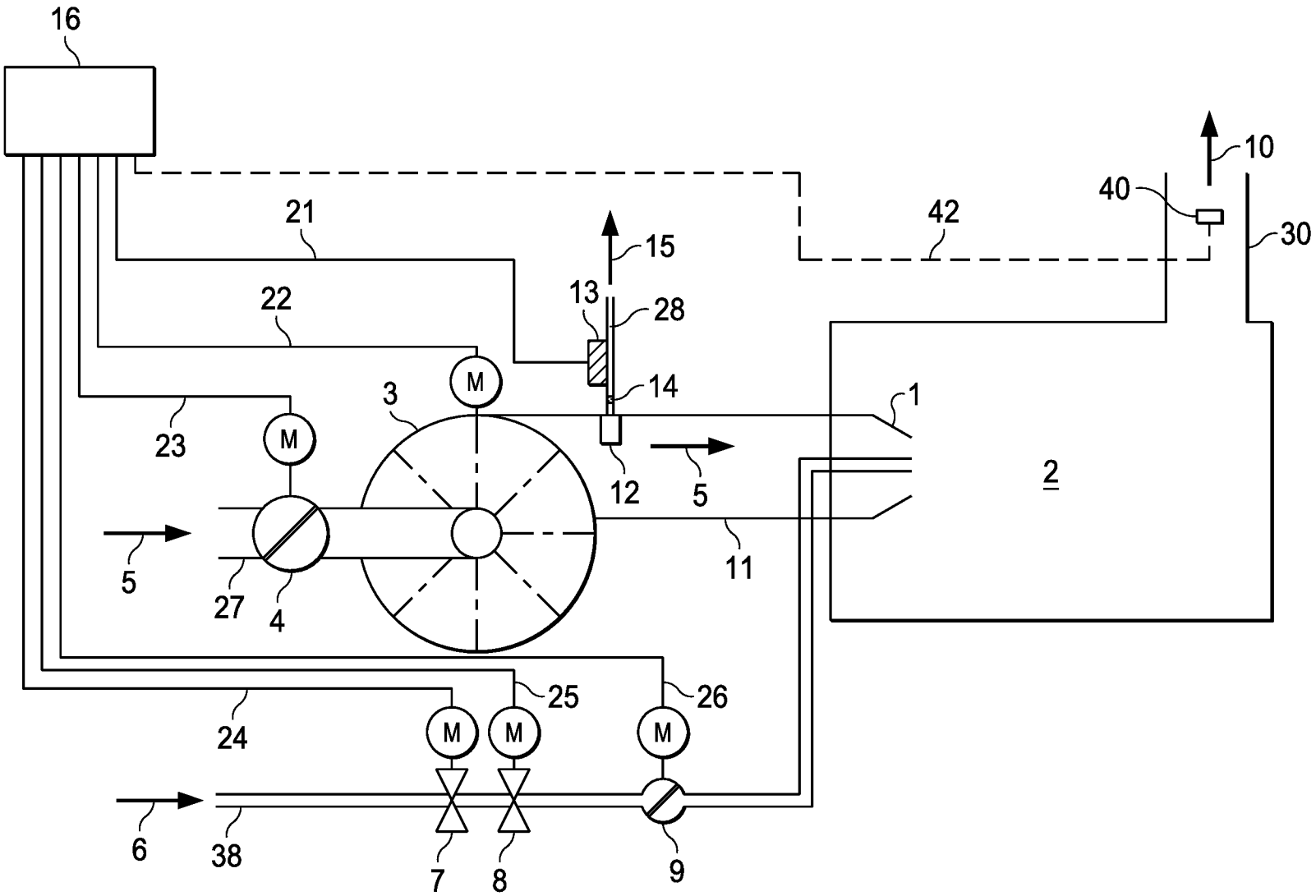
FIG. 1 shows a schematic of a system with a combustion device, wherein the flow of a fluid in an air feed is measured in accordance with teachings of the present disclosure.

The present disclosure teaches methods and/or devices for regulating flows in combustion devices in the presence of turbulence. For this purpose, a side duct in the combustion device is connected to a feed and/or to an outlet for a gaseous fluid. The side duct is connected to the feed or outlet such that a fluid can flow from the feed and/or outlet into the side duct. Introduced into the side duct is at least one flow resistance element. Thus, the mass flow sensor in the side duct is insensitive to solid particles and/or droplets in the fluid, which could otherwise strike the mass flow sensor. The mass flow sensor could possibly be damaged by solid particles and/or droplets striking it. In addition, the flow resistance element reduces the turbulence of the throughflow at the mass flow sensor.

A regulation device may be connected to at least one first, controlled actuator and to at least one second, regulated actuator. The desired throughflow of air is set with the two actuators. To achieve a desired throughflow of air through the main duct, the regulation device first sets the controlled actuator on the basis of values set and/or established in the regulation device for the fuel according to the desired throughflow in the main duct (feed and/or outlet). The regulation device may determine the throughflow in the main duct on the basis of the signal of the mass flow sensor in the side duct. It subsequently forms the difference from the required value. The regulation device regulates the second, regulated actuator on the basis of the difference formed.

In some embodiments, establishment of the desired throughflow of the air or of the fuel is the result of a superordinate temperature regulation. In this case the temperature of a medium and/or of an item in the heat consumer is held at a required value with the aid of a temperature regulation. In some embodiments, the amount setting of one or more actuators for setting the air throughflow is determined via a functional relationship from a predetermined air throughflow stored in each case. In this case one of the actuators will be regulated to set the air throughflow with the aid of the flow sensor in the side duct so that the predetermined value of the air throughflow is reached.

In some embodiments, the setting of the amount of fuel and the air throughflow, the value of which is determined with the aid of the flow sensor in the side duct, are assigned to one another. Such an assignment can be made either by a fixed assignment and/or by an assignment as a result of a λ regulation.

In some embodiments, the burner performance is determined via the air throughflow, which is determined via the mass flow sensor in the side duct. With the aid of the mass flow sensor influences such as air temperature and/or barometric pressure on the air are compensated for. If the air/fuel ratio λ is kept constant with the aid of a regulation, the burner performance remains (almost) the same regardless of the type of fuel.

In some embodiments, the method and/or the device provide fail-safe regulation of a flow in a combustion device. In some embodiments, the method and/or the device provide for recognizing faults in the combustion device, in particular for recognizing faults in the actuators of the combustion device.

In some embodiments, at least one actuator is controlled and/or regulated on the basis of a pulse-width-modulated signal. In some embodiments, at least one actuator is controlled and/or regulated on the basis of a converter.

In some embodiments, the noise in the signal of the mass flow sensor generated by turbulence is filtered on the basis of a (electronic and/or digital) circuit. Filtering may be done on the basis of a moving average value filter and/or on the basis of a filter with a finite pulse response and/or on the basis of a filter with an infinite pulse response and/or on the basis of a Chebyshev filter.

FIG. 1 shows a system comprising a burner 1, a heat consumer 2, a fan 3 with a speed that can be set, and a flap 4 with motorized adjustment. The flap 4 with motorized adjustment may be arranged after the air entry 27. The heat consumer 2 (heat exchanger) can be a hot water vessel for example. The throughflow (particle flow and/or mass flow) 5 of the fluid air can be set in accordance with FIG. 1 both by the flap 4 with motorized adjustment and/or by specifying the rotational speed 22 of the fan. In the absence of the flap 4, the air throughflow 5 can be adjusted solely by setting the speed of the fan 3. Pulse width modulation comes into consideration for adjusting the speed of the fan 3 for example. In some embodiments, the motor of the fan is connected to a converter. The speed of the fan is thus adjusted via the frequency of the converter.

In some embodiments, the fan runs at a fixed, invariable speed. The air throughflow 5 is then defined by the position of the flap 4. In some embodiments, further actuators are used, which change the air throughflow 5. In such cases an adjustment of the burner nozzle and/or an adjustable flap in the waste gas vent duct can be involved.

In some embodiments, the throughflow 6 (for example particle flow and/or mass flow) of the fluid fuel through the fuel feed duct 38 is set by a fuel flap 9. In some embodiments, the fuel flap 9 is a valve (with motorized adjustment).

In some embodiments, combustible gases such as natural gas and/or propane gas and/or hydrogen are used as fuel. In some embodiments, a liquid fuel such as heating oil is used as a fuel. In some embodiments, the flap 9 is replaced by an oil pressure regulator with motorized adjustment in the return of the oil nozzle. In some embodiments, the safety shutdown function and/or closing function may include redundant safety valves 7-8. In some embodiments, the safety valves 7-8 and/or the fuel flap 9 are realized as an integrated unit (as integrated units).

In some embodiments, the burner 1 comprises a combustion engine, e.g., a combustion engine of a system with power-heat coupling.

Fuel is mixed into the flow of air 5 in and/or before the burner 1. The mixture is burned in the combustion chamber of the heat consumer 2. The heat is transported onwards in the heat consumer 2. For example, heated water is taken away via a pump to heating elements and/or in industrial firing systems an item is heated (directly). The exhaust gas flow 10 is vented (into the environment) via an exhaust gas path 30, for example a chimney.

In some embodiments, a closed-loop and/or open-loop control and/or monitoring device 16 coordinates all actuators so that the correct throughput 6 of fuel is set via the setting of the flap 9 for the corresponding throughput 5 of air for each performance point. Thus, the desired fuel/air ratio λ is produced. In some embodiments, the closed-loop and/or open-loop control and/or monitoring device 16 comprises a microcontroller.

In some embodiments, the closed-loop and/or open-loop control and/or monitoring device 16 sets the fan 3 via the signal 22 and the air flap 4 via the signal 23 to the values stored in the closed-loop and/or open-loop control and/or monitoring device 16 (in the form of a characteristic curve). In some embodiments, the closed-loop and/or open-loop control and/or monitoring device 16 comprises a (non-volatile) memory. Those values are stored in the memory. The setting of the fuel flap 9 is specified via the signal 26. In operation, the safety shut-off valves 7, 8 are opened via the signals 24, 25. The safety shut-off valves 7, 8 are held open during operation.

If faults are to be uncovered in the flap 4, 9 and/or in the fan 3 (for example in the (electronic) interface or control device of the flap and/or of the fan), then this can be done by a safety-oriented feedback of the position of the flap 4 via the (bidirectional) signal line 23 for the flap 4 and/or via the (bidirectional) signal line 26 for the flap 9. A safety-oriented position message can be realized for example via redundant position generators. If a safety-oriented feedback about the rotational speed is required, this can be done via the (bidirectional) signal line 22 using (safety-oriented) rotational speed generators. Redundant rotational speed generators can be used for this purpose for example and/or the measured speed can be compared with required speed. The activation and feedback signals can be transferred via different signal lines and/or via a bidirectional bus, for example a CAN bus.

In some embodiments, fitted before the burner is a side duct 28. A small amount of outflowing air 15 flows outwards through the side duct 28. In some embodiments, the air 15 flows out in this case into the space from which the fan 3 sucks in the air. In some embodiments, the outflowing air 15 flows out into the firing space of the heat consumer 2. In some embodiments, the air flows back into the air duct 11. In this case a flow resistance element (a diaphragm) is arranged (at least locally) in the air duct 11 between tapping off point and return. The side duct 28, together with the burner 1 and the waste gas path 30 of the heat consumer 2, form a flow divider. For a defined flow path through burner 1 and waste gas path 30, for a value of the air flow 5 (reversibly unambiguous) an associated value of an air flow 15 flows out through the side duct 28. The flow path through burner 1 and waste gas path 30 must only be defined in such cases for each performance point. It can thus vary over the performance (and thus over the air throughput). The side duct 28, depending on pressure conditions, can be both an outflow duct and also an inflow duct in relation to the air duct 11.

A flow resistance element (in the form of a diaphragm) 14 is fitted in the side duct 28. With the flow resistance element 14, the amount of outflowing air 15 of the flow divider is defined. The function of the diaphragm 14 as a defined flow resistor can also be realized by a small tube of defined length (and diameter). The function of the diaphragm 14 can also be realized by using a laminar flow element and/or by another defined flow resistor.

In some embodiments, the admittance surface of the flow resistance element 14 can be adjusted by a motor. To avoid and/or remedy blockages caused by suspended particles, the admittance surface of the flow resistance element 14 can be adjusted. In particular, the flow resistance element 14 can be opened and/or closed. The admittance surface of the flow resistance element may be adjusted multiple times in order to avoid and/or to remedy blockages.

The amount of flow 15 in the side duct 28 depends on the admittance surface of the flow resistance element 14. Therefore, the value of the flow 5 is stored for each admittance surface of flow-resistance element 14 via characteristic values stored in the (non-volatile memory). This enables the value of the flow 5 to be determined from the measured values of the flow 15.

With this arrangement, the throughflow (particle flow and/or mass flow) through the side duct 28 is a measure for the air flow 5 through the burner. In this case influences as a result of changes in the density of the air for example are compensated for by changes in the absolute pressure and/or the air temperature through the mass flow sensor 13. Normally the flow 15 is very much smaller than the air flow 5. Thus the air flow 5 is (in practice) not influenced by the side duct 28. In some embodiments, the (particle and/or mass) flow 15 through the side duct 28 is smaller by at least a factor of 100, by at least a factor of 1000, and/or by at least a factor of 10000 than the (particle and/or mass) flow 5 through the air duct 11.

Figure 2:
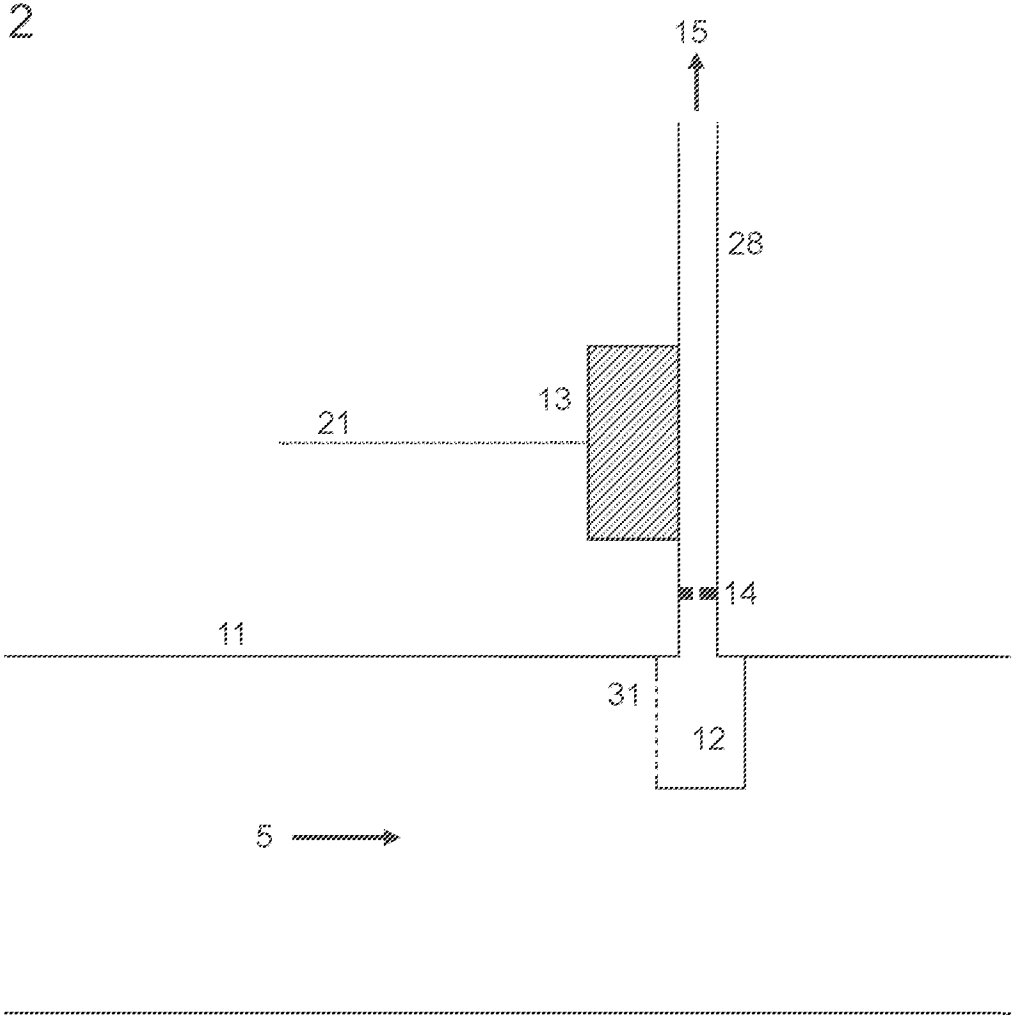
FIG. 2 shows the side duct in a detailed schematic in accordance with teachings of the present disclosure.

FIG. 2 shows the section in the area of the side duct 28 in an enlarged view. The value of the air flow 15 in side duct 28 is detected with the aid of a mass flow sensor 13. The signal of the sensor is transmitted via the signal line 21 to the closed-loop and/or open-loop control and/or monitoring device 16. In the closed-loop and/or open-loop control and/or monitoring device 16 the signal is mapped to a value of the air flow 15 through the side duct 28 and/or of the air flow 5 through the air duct 11. In accordance with a further form of embodiment a signal-processing device is present at the location of the mass flow sensor 13. The signal-processing device has a suitable interface for transferring a signal processed (for a value of the air flow) to the closed-loop and/or open-loop control and/or monitoring device 16.

Sensors such as the mass flow sensor 13 allow measurement at high flow speeds, specifically in conjunction with combustion devices in operation. Typical values of such flow speeds lie in ranges between 0.1 m/s and 5 m/s, 10 m/s, 15 m/s, 20 m/s, or even 100 m/s. Mass flow sensors, which are suitable for the present disclosure, are for example OMRON® D6F-W or SENSOR TECHNICS® WBA-type sensors. The usable range of these sensors typically begins at speeds between 0.01 m/s and 0.1 m/s and ends at a speed of for example 5 m/s, 10 m/s, 15 m/s, 20 m/s, or even 100 m/s. In other words, lower limits such as 0.1 m/s can be combined with upper limits such as 5 m/s, 10 m/s, 15 m/s, 20 m/s, or even 100 m/s.

Regardless of whether the signal processing is done in the closed-loop and/or open-loop control and/or monitoring device 16 or at the location of the mass flow sensor 13, the signal-processing device can contain a filter. The filter averages over fluctuations of the signal, which are caused by turbulences. A suitable filter for this purpose may include a moving average value filter, a filter with a finite pulse response, a filter with an infinite pulse response, a Chebyshev filter, etc. In some embodiments, the filter is designed as a (programmable) electronic circuit.

Some embodiments include Pitot probe 12, flow resistance element 14, and filter. The filter allows frequency parts of the fluctuations of the signal of the mass flow sensor 13 to be compensated for, which are barely able to be compensated for via the Pitot probe 12 and/or via the flow resistance element 14. In some embodiments, the Pitot probe 12 integrates pressure fluctuations of the mass flow 5 in the feed duct 11 of greater than 10 Hz, and/or of greater than 50 Hz. In some embodiments, the flow resistance element 14 damps pressure fluctuations of the mass flow 5 in the feed duct 11 by a factor of 5, by more than a factor of 10, or even by more than a factor of 40. Complementarily thereto the filter integrates fluctuations in the range of greater than 1 Hz, or greater than 10 Hz.

In some embodiments, individual or all signal lines 21-26 are designed as an (eight-wire) computer network cable with (or without) energy transmission integrated into the cable. In some embodiments, the units connected to the signal lines 21-26 communicate not only via the signal lines 21-26, but they are also supplied with energy for their operation via separate signal lines 21-26. In some embodiments, power of up to 25.5 Watts can be transmitted through the signal lines 21-26. In some embodiments, individual or all units connected to the signal lines 21-26 have internal energy stores such as accumulators and/or (super) capacitors. Thus the supply of energy to the connected units is insured especially in the event of the power of those units exceeding the power able to be transmitted via the signal lines 21-26. In some embodiments, the signals can be transmitted via a two-wire, bidirectional bus, e.g. a CAN bus.

The form of measuring a flow in a side duct 28 illustrated in FIG. 2 may be used for combustion devices. The air flow 5 in the air duct 11 between fan 3 and burner 1 is (in many cases) turbulent. The flow fluctuations resulting from turbulence in such cases lie in the same order of magnitude as the averaged value of the air flow 5. This means that a direct measurement of the value of the air flow 5 becomes significantly more difficult. The flow fluctuations occurring in the side duct 28 turn out to be much smaller than the flow fluctuations in the air duct 11 caused by the fan 3. Thus, with the arrangement shown in FIG. 2, a significantly improved signal-to-noise ratio of the signal of the mass flow sensor 13 is obtained. The side duct 28 is constructed so that (practically) no relevant macroscopic flow profile of the air flow 15 is obtained. In the side duct 28 the air flow 15 preferably slides in a laminar manner over the mass flow sensor 13. The person skilled in the art uses the Reynolds number $Re_D$ inter alia to divide the mass flow 15 of a fluid in the side duct 28 with diameter D into laminar or turbulent. In accordance with one form of embodiment, flows with Reynolds numbers $Re_D<4000$, with $Re_D<2300$, or with $Re_D<1000$, may be considered laminar.

In some embodiments, the admittance surface of the flow resistance element 14 is dimensioned to let a defined, e.g. laminar, flow profile (of a mass flow 15) arise in the side duct 28. A defined flow profile in the side duct 28 is characterized by a defined speed distribution of a mass flow 15 as a function of the radius of the side duct 28. The mass flow 15 thus does not run chaotically. A defined flow profile may be unique for each flow amount 15 in the side duct 28. With a defined flow profile, the flow value measured locally at the mass flow is representative for the flow amount in the side duct 28. It is thus representative for the flow amount 5 in the feed duct 11. A defined flow profile (of a mass flow 15) in the side duct 28 may be not turbulent. In particular, a defined flow profile (of a mass flow 15) in the side duct 28 can have a (parabolic) speed distribution as a function of the radius of the side duct 28.

In the arrangement in accordance with FIG. 2 however an indirect pressure measurement is involved. By contrast with a pressure measurement, changes in the mass flow as a result of a temperature change are detected as well. The device disclosed here is also capable of compensating for temperature changes with the aid of the closed-loop and/or open-loop control and/or monitoring device 16. The mass flow sensor 13 is to be installed on practically any system on the pressure side (in a manner which is simple for the person skilled in the art).

In some embodiments, to reduce the influence of turbulences even further, the air flow 15 can be directed over the Pitot probe 12 in the side duct 28. The Pitot probe 12 is arranged in the air duct 11. The Pitot probe 12 is designed in the form of a tube with any given cross section (for example round, angular, triangular, trapezoidal, and/or round). The end of the tube 12 in the direction of the main air flow 5 is closed. The end of the tube, which projects out of the tube with the main flow 5, forms the beginning of the side duct 28. That end opens out into the side duct 28. Made laterally on the side of the Pitot probe 12 in the direction from which the air flow 5 comes are a number of inlet openings (for example slots and/or holes) 31. Through the opening 31 a fluid, such as for example air from the air duct 11 can enter into the Pitot probe 12. Thus the Pitot probe 12 has a fluid connection via the openings 31 with the air duct 11. The total surface of the openings 31 (the cross section of the openings 31 through which fluid can flow) is far greater than the admittance surface of the flow resistance element 14. Thus the admittance surface of the flow resistance element 14 is (in practice) determining for the value of the air flow 15 through the side duct 28. In some embodiments, the total cross section of the openings 31 through which fluid can flow is greater at least by a factor of 2, at least by a factor of 10, and/or at least by a factor of 20, than the admittance surface of the flow resistance element 14.

In some embodiments, there is a small surface area for the total surface of the openings 31 compared to the cross-section of the Pitot probe 12. This means that fluctuations of the turbulent main flow 5 have (in practice) no effect. In the tube of the Pitot probe a calmed constriction pressure is established. In some embodiments, the total cross-section of the openings 31 through which fluid can flow is smaller at least by a factor of 2, at least by a factor of 5, and/or at least by a factor of 10, than the cross-section of the Pitot probe 12.

A further advantage of the arrangement lies in the fact that suspended particles and/or droplets are very unlikely to get into the side duct 28. Through the significantly lower speeds of the air in the side duct 28 and through the constriction pressure in the Pitot probe 12 suspended particles and/or droplets will continue to be swirled in the turbulent main flow 5. Larger solid particles and/or droplets can barely get into the Pitot probe 12 because of the constriction pressure and because of the openings 31. They will be swirled past the Pitot probe 12. To this end the individual openings of the inlet 31 have diameters of less than 5 mm, of less than 3 mm, and/or of less than 1.5 mm.

In some embodiments, the openings 31 along the Pitot probe 12 are such that the average value of the constriction pressure is formed over a macroscopic flow profile of the air flow 5 in the Pitot probe 12. In some embodiments, there is a Pitot probe 12 of defined length to smooth a macroscopic flow profile of the air flow 5 inside the tube. This compensates for the respective flow conditions for different designs of air duct 11 via a length of the Pitot probe adapted to the air duct 11. Such compensation applies especially to air ducts with different diameters.

Figure 3:
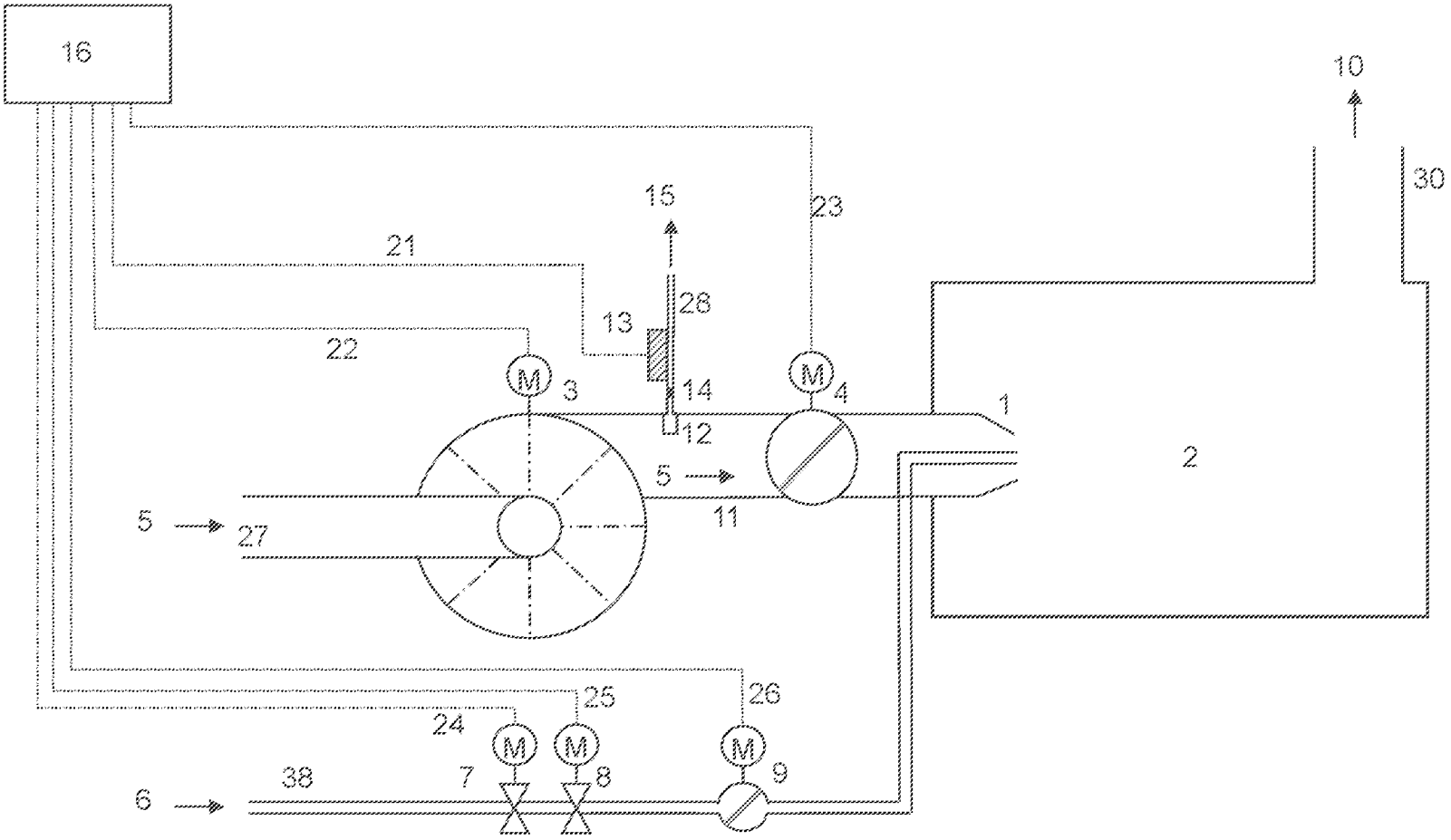
FIG. 3 shows a schematic of a system with a combustion device and with an air flap arranged on the pressure side in accordance with teachings of the present disclosure.

As a modified form of embodiment compared to FIG. 1, FIG. 3 shows a system with an air flap 4 able to be adjusted by a motor. The air flap 4 is arranged downstream of the fan 3. The air flap 4 is also arranged downstream of the side duct 28. The system from FIG. 3 allows the definition of a position of the air flap 4 and/or of the speed of the fan for each performance point. This produces (reversibly unambiguously) from each value of flow 5 and the (fed back) setting of the air flap 4 and/or the (fed back) speed of the fan 3, a flow value 15 in the side duct 28.

Figure 4:
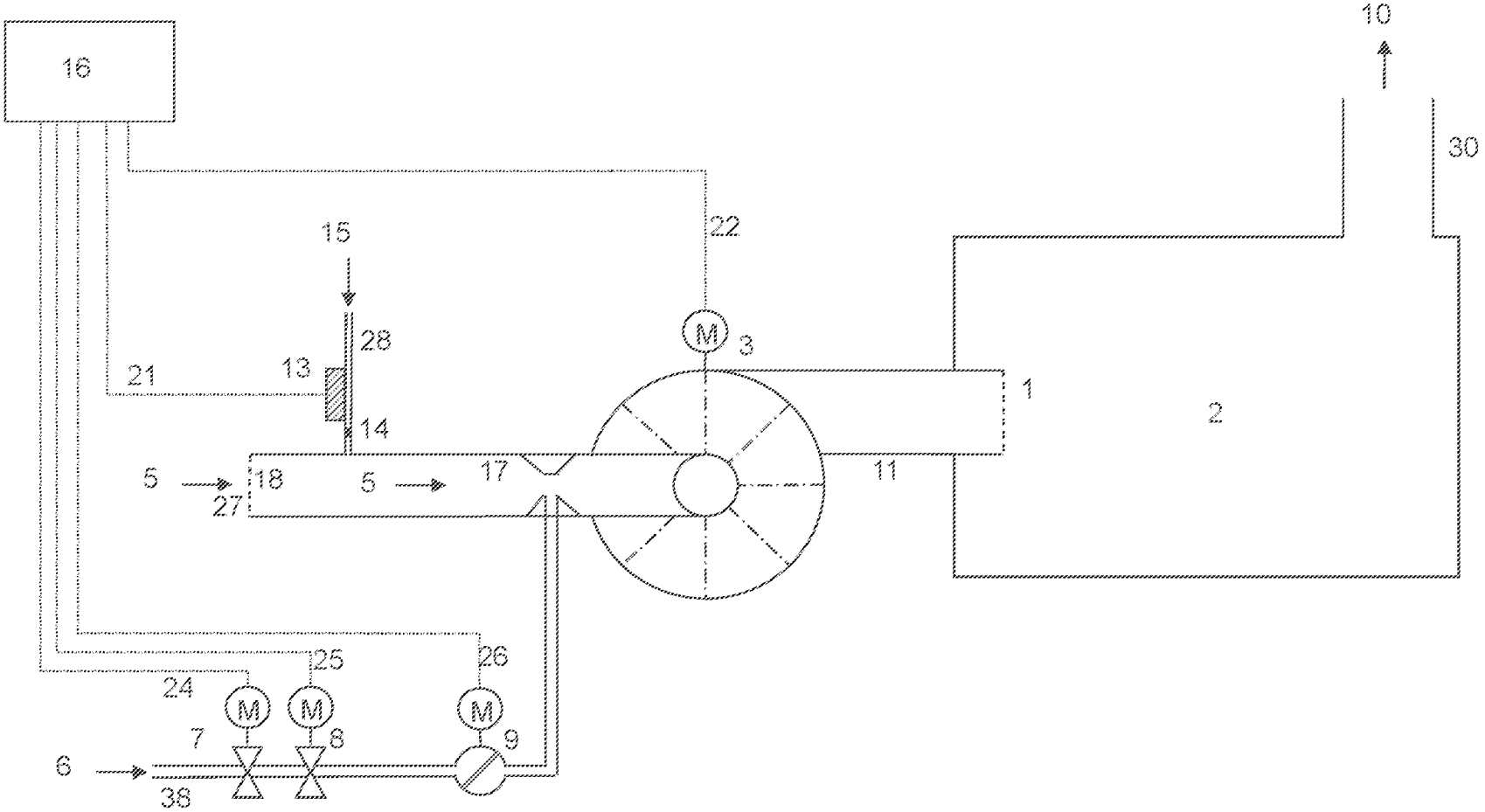
FIG. 4 shows a schematic of a system with a combustion device and with a mixing device before the fan in accordance with teachings of the present disclosure.

As a modified form of embodiment compared to FIG. 1 and FIG. 3, FIG. 4 shows a system with a mixing device 17 before the fan 3. By contrast with the systems from FIG. 1 and from FIG. 3, fuel is not mixed with air at the burner 1. Instead fuel is mixed-in with the air flow 5 before the fan 3 using a mixing device 17. There is accordingly the fuel/air mixture in the fan 3 (and in the duct 11). The fuel/air mixture is subsequently burned in the burner 1 in the firing space of the heat consumer 2.

By contrast with FIG. 1 and FIG. 3, the air 15 flows in on the suction side over the mass flow sensor 13. The fan 3 creates a vacuum at this location. In other words, the side duct 28 is an inflow duct. The side duct 28 is advantageously arranged before the mixing device 17. This means that any possible vacuum generated by the mixing device 17 has no effect on the throughflow 15 (particle flow and/or mass flow) through the side duct 28.

Changes in the amount of gas as a result of adjustments of the fuel flap 9 with motorized adjustment do not influence the throughflow 15 through the side duct 28. The mixing device 17 (in practice) no longer has any effect in the area of the side duct 28. Should the vacuum in the feed of the fan 3 not suffice, then a defined flow-resistance element can be created with a flow resistance element 18 at the entry 27 of the fan feed. Together with the flow resistance element 14 in the side duct 28 a flow divider is realized.

In FIG. 4 the fluid flow 5 can only be set via the fan 3 with the aid of the signal line 22. In some embodiments, a flap (with motorized adjustment) can be installed in addition. Such a flap is arranged on the pressure side or the suction side in relation to the fan 3. In some embodiments, the fan can be installed instead of the flow resistance element 18. It is then practically embodied as a flow resistance element with motorized adjustment (with feedback).

The mass flow sensor 13 is to be fitted on the suction side of practically any system (in a manner which is simple for the person skilled in the art). The systems disclosed in FIG. 3 and FIG. 4 also compensate for changes in density of the air, as illustrated for FIG. 1. In each case the particle and/or mass flow 5 of the fluid through the burner 1 is established.

The throughflow 15 in the side duct 28 is measured with a mass flow sensor 13. The mass flow sensor 13 is arranged in the feed duct/outflow duct 28. The mass flow sensor 13 may operate in accordance with the anemometer principle. In this principle, an (electrically) operated heater heats the fluid. The heating resistance can simultaneously be used as a temperature measurement resistance. The reference temperature of the fluid is measured in a measuring element before the heating resistance. The reference temperature measuring element can likewise be designed as a resistor, for example in the form of a PT-1000 element. In some embodiments, heating resistor and reference temperature resistor are arranged on one chip. The person skilled in the art recognizes that in this case the heating must be sufficiently thermally decoupled from the reference temperature measurement element.

The anemometer can be operated in one of two possible ways. In some embodiments, heating resistor is heated with a constant, known heating power, heating voltage and/or heating current. The difference temperature of the heater from the reference temperature measurement element is a measure for the throughflow (particle flow and/or mass flow) in the side duct 28. It is thus likewise a measure for the throughflow 5 (particle flow and/or mass flow) of the main flow (through duct 11).

In some embodiments, the heater is heated in a closed temperature-regulation circuit. A constant temperature of the heater is thus produced. The temperature of the heater is (apart from fluctuations through the regulation) equal to the temperature of the required value of the regulation circuit. The required value of the temperature of the heater is defined by a constant temperature difference being added to the measured temperature of the reference temperature measurement element. The constant temperature difference thus corresponds to the over temperature of the heater in relation to the reference temperature measurement element. The power introduced into the heater is a measure for the throughflow (particle flow and/or mass flow) in the side duct 28. It is thus likewise a measure for the throughflow 5 (particle flow and/or mass flow) of the main flow.

Figure 5:
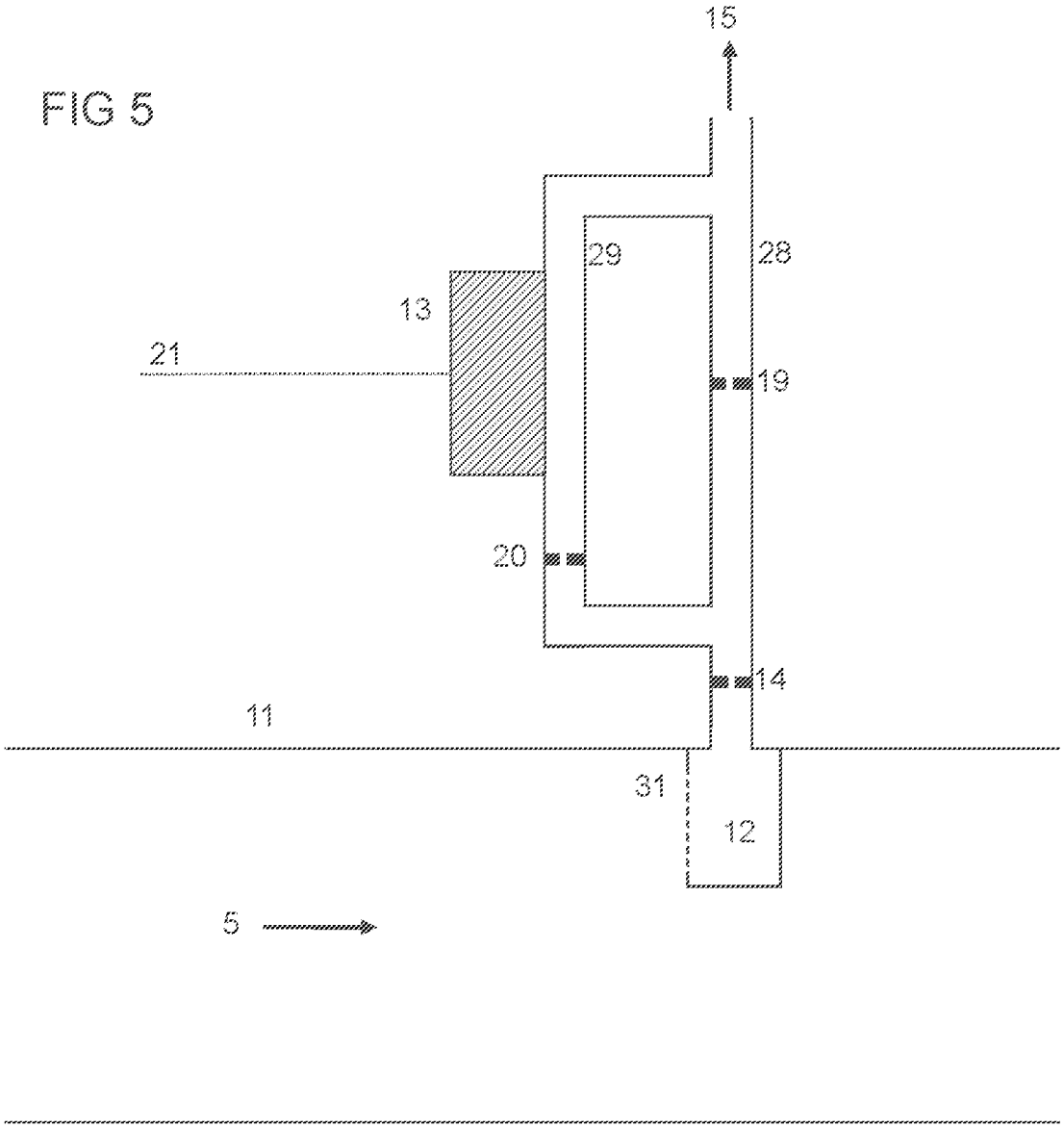
FIG. 5 shows a schematic of a side duct with bypass duct in accordance with teachings of the present disclosure.

The measurement range of the flow sensor can in such cases under some circumstances correspond to a small flow 15 in the side duct 28. Consequently, with a sufficiently high fan pressure, the admittance surface of the flow resistance element 14, which determines the throughflow 15, must be designed small. With such small admittance surfaces the danger exists that the flow resistance element 14 will be blocked by suspended particles. FIG. 5 teaches how a pressure divider with bypass duct 29 can be constructed in such cases.

A second flow resistance element 19 with a larger admittance surface then lies behind the first flow resistance element 14. Thus the pressure is divided between the two flow resistance elements 14 and 19. The admittance surfaces of the flow resistance elements 14 and 19 determine the division of the pressure. Arranged before the mass flow sensor 13 in the bypass duct 29 is a further flow resistance element 20. The admittance surface of the flow resistance element 20 may be sufficiently large. The admittance surface of the flow resistance element 20 may be adapted to the mass flow sensor 13. With the sub-flow divider constructed in this way the throughflow 5 (particle flow and/or mass flow) through duct 11 can then be deduced (reversibly unambiguously).

For a fault-tolerant version of the measurement process the mass flow sensor 13 can be realized with (dual) redundancy with result comparison. The dual design initially involves the mass flow sensor itself as well as the signal-processing device. The result comparison can then be carried out in secure hardware and/or software at the location of the sensor and/or in the closed-loop and/or open-loop control and/or monitoring device 16. In accordance with a further form of embodiment the side duct 28 is realized with (dual) redundancy. In some embodiments, each redundant side duct 28 present comprises a flow resistance element 14. This allows faults caused by blocked flow resistance elements 14 to be uncovered. The branch for the second side duct preferably lies in this case between flow resistance element 14 and Pitot probe 12. The Pitot probe 12 can be assumed to be fault-tolerant on account of the (comparatively) large openings 31.

Other faults such as formation of deposits on the mass flow sensor 13, scratches and/or other damage, which have an influence on the measurement signal, can be recognized. The (dual) redundant structure of the signal-processing device also enables faults in the signal-processing device to be recognized. In accordance with one form of embodiment the measurement values of the redundant mass flow sensors 13 present, preferably with formation of average values in each case, are compared with each other by subtraction. The difference Δ then lies within a threshold value band $$-\varepsilon_1 \leq \lambda \leq \varepsilon_2$$

with the limits $\varepsilon_1$ and £$_2$. With the aid of a characteristic curve of the respective limit values $\varepsilon_1$ and $\varepsilon_2$ over the required value of the throughflow 5, the difference Δ can then be compared and evaluated for each required value of the throughflow 5.

With the arrangement described the throughflow 5 (particle flow and/or mass flow) through duct 11 can be regulated out via the fan 3 on the basis of a sensor signal 21. To reach the required value of the throughflow 5, all air actuators 4, with the exception of the speed of the fan 3, will each be set to a required position entered as a fixed value. The required positions for the required throughflow 5 (particle flow and/or mass flow) through duct 11 are stored in the closed-loop and/or open-loop control and/or monitoring device 16. On the basis of a closed regulation circuit the speed of the fan 3 is adjusted until such time as the sensor measured value 21 reaches the value stored in the memory for the required throughflow.

Figure 6:
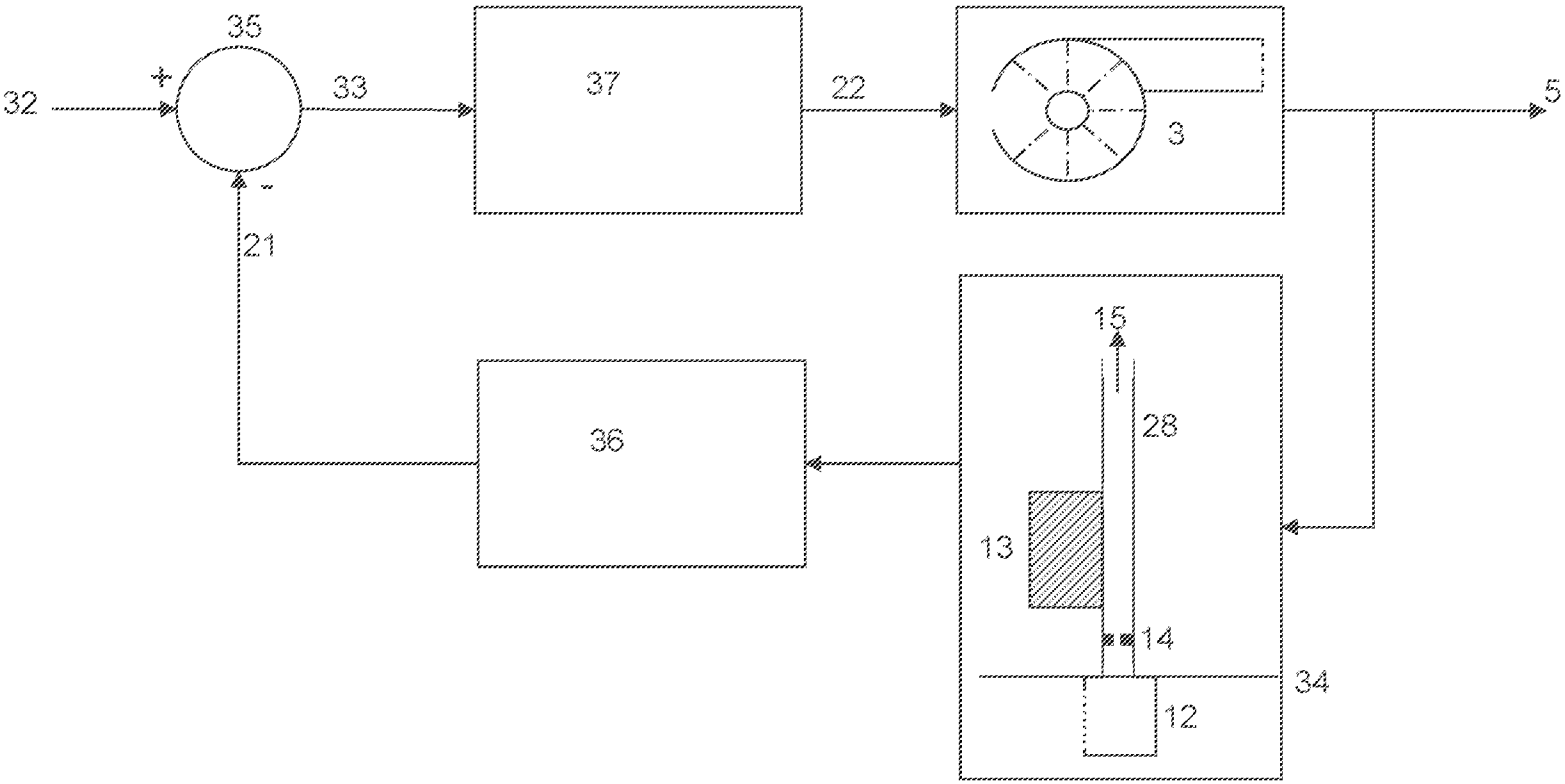
FIG. 6 shows a schematic of a regulation circuit for the system in accordance with teachings of the present disclosure.

FIG. 6 shows the regulation circuit. The associated required value 32 for the throughflow 15 in the side duct 28 for the requested throughflow 5 (particle flow and/or mass flow) through duct 11 is stored in the memory of the closed-loop and/or open-loop control and/or monitoring device 16. A comparison between required value and signal 21 of the mass flow sensor 13 produces a required/actual deviation 33 via a (device for) difference formation. By means of a regulator 37, which can be designed as a (self-adapting) PI controller or as a (self-adapting) PID controller, the setting signal 22 is predetermined for the fan 3. The fan 3 generates, as a response to the setting signal 22, the throughflow 5 (particle flow and/or mass flow) through duct 11. The signal 21 is generated with the aid of the aforementioned measurement arrangement 34 comprising the side duct 28, at least one flow resistor 14, the mass flow sensor 13 and optionally the Pitot probe 12. The signal 21 is a (reversibly unambiguous) measure for the throughflow 5 (particle flow and/or mass flow) through duct 11. The regulation circuit disclosed here compensates for changes in air density. Such changes occur for example as a result of temperature fluctuations and/or changes in the absolute pressure.

The regulator 29 can also be realized as a fuzzy logic regulator and/or as a neural network. The setting signal for the fan 3 can be a pulse-width-modulated signal for example. In some embodiments, the setting signal 22 for the fan 3 is an alternating current generated by a (matrix) converter. The frequency of the alternating current corresponds to (is proportional to) the rotational speed of the fan 3.

If the system is to be designed to be fail-safe, the required positions of the actuators 4 must be established in a fail-safe manner. This is done for example on the basis of two position sensors (angular position sensor, stroke sensor, light barrier etc.).

The optional (electronic) filter 36 smoothes the measurement signal. In some embodiments, the filter 36 can be of an adaptive design. To this end the measurement signal is averaged over a long, maximum integration time (for example two seconds to five seconds) as a comparison value with a moving average value filter. If a measured value deviates from the average value or alternatively from the required value 32 outside a predetermined band, a jump in the required value is assumed. The measured value will now be used directly as the actual value. Thus the regulation circuit reacts immediately with the sampling rate of the regulation circuit.

If the measured values again lie within the defined band, the integration time is increased step-by-step with (each) sampling of the regulation circuit. The value integrated in this way is used as the actual value. This is done until such time as the maximum integration time is reached. The regulation circuit is now seen as stationary. The value averaged in this way is now used as the actual value. The disclosed method makes possible an exact stationary measurement signal at maximum dynamic.

In some embodiments, with a closed-loop control and/or open-loop control and/or monitoring device 16 designed as a microcontroller, the assignment of the settings 23 of the at least one air actuator 4 and of the required value 32 for the mass flow sensor 13 is stored as a function of the throughflow (particle flow and/or mass flow) through duct 11. In some embodiments, the function is stored in tabular form. Intermediate values between the points defined by the table will be interpolated linearly. As an alternative, intermediate values between the points defined by the table will be interpolated by a polynomial over a number of adjacent values and/or over cubic splines. Further forms of interpolation are also able to be realized.

In some embodiments, the closed-loop control and/or open-loop control and/or monitoring device 16 has a reader device for identification on the basis of radio-frequency waves (RFID reader device). The closed-loop control and/or open-loop control and/or monitoring device 16 is embodied, using the reader device, to read in operating parameters such as formulae (of polynomials defined in sections) and/or like the aforementioned tables from a so-called RFID transponder. The operating parameters are subsequently stored in (non-volatile) memory of the closed-loop control and/or open-loop control and/or monitoring device 16. If necessary they can be read out and/or used by a microprocessor.

In the table given below, as well as the required value for the mass flow sensor 13 in the side duct 28, the values for the motorized valve 4 are shown. Furthermore the values for a further flap or valve (with motorized adjustment) acting on the throughflow (particle flow and/or mass flow) through duct 11 are shown in the table below. Depending on the form of embodiment, further actuators can also be added in the form of table columns. In accordance with a specific form of embodiment none of the flaps is present. This means that the corresponding table columns are omitted.

| Throughflow 5 (particle flow and/or mass flow) through duct 11 | Flap or valve 4 (with motorized adjustment) | Further flap or further valve (with motorized adjustment) | Required value 32 for throughflow 15 (particle flow and/or mass flow) through side duct 28 |
|---|---|---|---|
| Value 1 | Angle 1 | Angle 1 | Flow value 1 |
| Value 2 | Angle 2 | Angle 2 | Flow value 2 |
| . . . | . . . | . . . | . . . |
| Value n | Angle n | Angle n | Flow value n |

If a specific value of the throughflow 5 (particle flow and/or mass flow) through duct 11 is to be set, then the two values between which the desired value of the throughflow lies are sought in the table. Subsequently the position between the two values is established. If the desired value of the throughflow 5 lies by an amount s % between the values k and k+1 ($1 \leq k \leq n$) then the angle of the flap or valve 4 (with motorized adjustment) at a distance of s % between the angles k and k+1 is also approached. The behavior for the angle (of the setting) of the further flap or of the further valve (with motorized adjustment is the same. The throughflow value 5 can be specified as an absolute figure and/or relative to a value, preferably relative to the throughflow 5 at the greatest performance value. The throughflow value is then for example stored as a percentage of the throughflow 5 of the greatest performance value.

In some embodiments, instead of being stored in the aforementioned table, the settings of the at least one air actuator 4 are stored as a polynomial as a function of throughflow 5 (particle flow and/or mass flow) through duct 11. In accordance with yet another form of embodiment the settings of the at least one air actuator 4 are stored as functions defined in sections as a function of throughflow 5 (particle flow and/or mass flow) through duct 11. In accordance with one more form of embodiment the settings of the at least one air actuator 4 are stored as (valve) opening curve(s).

In order to exclude an incorrect assumption of a value of the air throughput, for example because of failed components and/or defective supply leads, the design can be undertaken in a fail-safe way. This means that the at least one actuator 4 from the aforementioned table can move to its setting while being monitored. This also means that the throughflow 15 (particle flow and/or mass flow) through side duct 28 is acquired in a safety-oriented manner.

If a predetermined throughflow 5 through the duct 11 is to be set, the correct combination of settings of the at least one actuator and throughflow 15 through side duct 28 will be established and moved to. This even occurs when the characteristic curve of individual actuators is not linear. For a sequence of characteristic curve points with a sufficiently close spacing to one another, an (almost) linear scale is obtained for the throughflow 5. This is of great advantage for the operation of the combustion device.

In the table shown above the setting of the actuator 9, with which the fuel throughput 6 is set, can also be assumed. This setting can be both the position of a flap and/or the position or opening of a fuel valve and/or a measured flow value of the fuel throughput 6.

This means that for a preset air/fuel ratio λ the correct fuel throughput 6 will always be assigned at each throughput 5. The air throughput 5 thus becomes synonymous with the performance value, since fuel throughput 6 and air throughput 5 conveyed have a fixed connection to one another. Conversely, for setting the performance, the fuel throughput 6 or the setting of the fuel actuator 9 can be defined. In the table the assigned air throughput 5 can be determined on the basis of the characteristic curve and/or on the basis of the linear interpolation between the table values. The positions of the air actuators 4 and also the required value of the mass flow 32 of air can be interpolated using the table as described above and/or be determined via another mathematical assignment.

In some embodiments, the values for the throughflow 5 are specified as absolute values in the closed-loop control and/or open-loop control and/or monitoring device 16. In some embodiments, the values for the throughflow 5 are specified in the closed-loop control and/or open-loop control and/or monitoring device 16 relative to a specified value of the throughflow. In some embodiments, the values for the throughflow are specified in the closed-loop control and/or open-loop control and/or monitoring device 16 relative to the maximum throughput 5 (of air) at maximum power.

In some embodiments, fuel throughput 6 is not assigned directly to the air throughput 5. In this form of embodiment, in a second functional assignment, the setting of the fuel flap or of the fuel valve 9 is assigned to the fuel throughput 6. As with the air, this can take place with a table, as is shown below

| Fuel throughput 6 | Fuel flap or fuel valve 9 (with motorized adjustment) |
|---|---|
| Value 1 | Angle 1 |
| Value 2 | Angle 2 |
| . . . | . . . |
| Value n | Angle n |

There can also be (linear) interpolation here between the individual values. The assignment can naturally also be made via polynomials, which are at least defined in sections.

The fuel throughput 6 defined in the table in this case is an absolute or relative value for a fuel/air ratio $\lambda_0$. The fuel throughput 6 stored in the table in this case is also an absolute or relative value for the fuel present in the fuel feed during a setting process. The fuel/air ratio $\lambda_0$ is usually predetermined during the setting process. The functional assignment is made during the said setting process. In this process the air throughput defined in the linearized scale is assigned to the fuel throughput 6 of the fuel conveyed at the defined fuel/air ratio $\lambda_0$. In this way the position of the fuel actuator 9 is mapped onto a linear scale of the fuel throughput 6.

The air throughput 5 known on a linear scale with formula characters $\dot{V}_L$ and the fuel throughput 6 known on a linear scale with formula characters $\dot{V}_G$ are then interrelated via the equation $\dot{V}_L=\lambda\cdot L_{min}\cdot\dot{V}_G$. $L_{min}$ in this case is the minimum air requirement of the fuel, i.e. the ratio of air throughput 5 that is necessary for conditions of stoichiometry, compared to the fuel throughput 6. $L_{min}$ is a variable that depends on the composition of the fuel or on the type of fuel.

During the setting the fuel composition has the minimum air requirement $L_{min0}$. Thus, during the setting process the relationship $$\dot{V}_{L0}=\lambda_0\cdot L_{min0}\cdot\dot{V}_{G0}$$

exists between the air throughput during the setting process $\dot{V}_{L0}$, the air/fuel ratio during the setting process $\lambda_0$, the minimum air requirement during the setting process $L_{min0}$ and the fuel throughput during setting process $\dot{V}_{G0}$. At the maximum performance point the relationship $$\dot{V}_{L0max}=\lambda_0\cdot L_{min0}\cdot\dot{V}_{G0max}$$

exists with the air throughput at the maximum performance point $\dot{V}_{L0max}$ and with the fuel throughput $\dot{V}_{G0max}$ at the maximum performance point. In each case in relation to the air throughput 5 or fuel throughput 6 at maximum power, as defined during the setting process, for each operating state the relationship $$\frac{\dot{V}_L}{\dot{V}_{L0max}}=\frac{\lambda}{\lambda_0}\cdot\frac{L_{min}}{L_{min0}}\cdot\frac{\dot{V}_G}{\dot{V}_{G0max}}$$

is produced for the air throughput 5 as a function of fuel throughput 6. With the respective relative value of air throughput 5

$$\frac{\dot{V}_L}{\dot{V}_{L0max}}=\dot{V}_{RL}$$

and the relative value of fuel throughput 6

$$\frac{\dot{V}_G}{\dot{V}_{G0max}}=\dot{V}_{RG}$$

the relationship becomes:

$$\dot{V}_{RL}=\frac{\lambda}{\lambda_0}\cdot\frac{L_{min}}{L_{min0}}\cdot\dot{V}_{RG}$$

If there are conditions such as with the setting in relation to air/fuel ratio λ and gas composition, then $\dot{V}_{RL}=\dot{V}_{RG}$. Thus the relative air throughput is equal to the relative fuel throughput, as was also defined during the setting process in relation to the maximum values.

If the gas composition changes for example, then the minimum air requirement $L_{min}$ also changes, so that it becomes the case that $$\frac{L_{min}}{L_{min0}}=F\neq 1.$$

Then the fuel throughput 6 must be increased by the factor 1/F, if the air/fuel ratio λ is to remain at the same value. In other words, for a change in the composition of the fuel, in which the minimum air requirement $L_{min}$ increases by the factor F, for an air/fuel ratio λ which remains the same, the fuel throughput 6 will be reduced by the factor F in relation to the setting conditions. As an alternative the air throughput 5 can also be increased by the factor F.

If one wishes to change the air/fuel ratio λ by the factor F, the fuel throughput 6 must likewise be reduced by the factor F or the air throughput must be increased by the factor F.

Both values, air throughput 5 and fuel throughput 6, are present in each case in an almost linear scale. It is thus sufficient to know the factor F for a performance point, in order thereby to calculate the fuel throughput 6 for each performance point from the values stored during the setting, if the air throughput 5 is used as a performance variable. If the fuel throughput 6 is used as a performance variable 5, in an equivalent way the correct air throughput 5 can be calculated for each performance point.

With the respective assignments of the positions to the air adjusters 4 or to the required value 32 in the outflow duct for the air throughput 5 and the assignment of the setting of the fuel actuator 9 to the fuel throughput 6, the corresponding positions can then be set for a predetermined performance value. The flow rate of the fan 3 can be regulated accordingly.

The current value for the fuel throughput 6 is thus assigned via a fixed factor to the current value of the air throughput 5. A basic factor is established during the setting, as shown above. For a direct presentation of air throughput 5 or fuel throughput 6 it amounts to $\lambda_0 \cdot L_{min0}$. For a presentation of air throughput 5 or fuel throughput 6 relative to the respective maximum values from the setting process, it is preferably set to one.

If the conditions change compared to the settings in respect of the air/fuel ratio λ or the composition of the fuel by a factor of F, then air throughput 5 or fuel throughput 6 are adapted by the factor 1/F compared to the stored setting values.

If, in a further form of embodiment, for changing compositions of the fuel, the factor F is established via a λ regulation, then this value also applies for all performance points. With the aid of the linear scales for air throughput 5 and fuel throughput 6, the performance can be changed significantly more quickly than the λ regulation would allow. Thus λ regulation and performance adjustment are decoupled from one another. This is very advantageous, since as a result of the system runtimes or the time constants of the system, the λ regulation circuit regulates out environment-related changes significantly more slowly than the performance is to be changed by comparison. Typical environment-related changes are air temperature, air pressure, fuel temperature and/or fuel type. Such changes normally occur so slowly that the λ regulation circuit is sufficiently fast for this purpose.

A λ regulation can be realized with the aid of an $O_2$ sensor in the exhaust gas. The person skilled in the art can easily calculate the air/fuel ratio λ from the derived measured value of an $O_2$ sensor in the exhaust gas.

In some embodiments, the use of the flow sensor 13 represents a particular advantage in the method presented. Fluctuations in the density of the air 5 caused by a change in temperature and/or fluctuations in barometric pressure are corrected by the regulation circuit depicted in FIG. 6. Thus a compensated value is already present for the linearized scale of air throughput 5. The λ regulation circuit then only has to regulate-out fluctuations in the gas composition.

If the air throughput 5 is selected as a performance variable, then for a changing composition of the fuel, the fuel throughput 6 will be adjusted by the λ regulation circuit, so that the burner performance remains almost constant. The reason for this is that the energy unit for most of the fuels generally used (approximately) correlates in a linear manner with the minimum air requirement $L_{min}$.

The regulation circuit in accordance with FIG. 6 also compensates for faults in the fan 3 and/or regulates these out. Faults in the fan 3 are for example a greater slippage of the fan wheel and/or faults in the (electronic) activation. Furthermore more serious faults of the fan 3, which can no longer be regulated-out, are able to be uncovered. To do this it is detected whether the activation speed 22 of the fan 3 lies outside a band for each throughflow 5 through the duct 11. Advantageously for this purpose, for given throughflows 5 (particle flow or mass flow) through the duct 11, upper and lower limit values of the rotational speed and/or the activation signals 22 of the fan 3 are stored in the aforementioned table. The values are especially preferably stored in a (non-volatile) memory of the closed-loop and/or open-loop and/or monitoring device 16. In accordance with a further form of embodiment the storage of upper and lower limit values for the rotational speed and/or the activation signals 22 of the fan 3 are defined on the basis of functions (defined in sections) such as straight lines and/or polynomials for example.

The throughflow 5 through duct 11 can also be regulated via another actuator. For example in FIG. 6 the regulation of the fan 3 can be replaced by a regulation of a flap 4 (with motorized adjustment). In this case, for each required value 32 of the throughflow 5, all actuators including that of the fan 3 with the exception of the regulated setting of the flap or valve 4 (with motorized adjustment) are set to a required position entered as a fixed value. The respective required position for a given throughflow 5 (particle flow and/or mass flow) through duct 11 is stored in the (non-volatile) memory of the closed-loop and/or open-loop and/or monitoring device 16. The settings of the actuators and the required value 32 of the throughflow 15 through the side duct 28 are also stored here as a function of the throughflow 5 through duct 11, as already mentioned above. The interpolation is undertaken as described above.

For the following table the regulation of the flap or of the valve (with motorized adjustment) means that the setting of each actuator is replaced by the rotational speed of the fan 3. A table adapted accordingly is reproduced below:

| Throughflow 5 (particle flow and/or mass flow) through duct 11 | Fan 3 | Further flap or further valve (with motorized adjustment) | Required value 32 for throughflow 15 (particle flow and/or mass flow) through side duct 28 |
|---|---|---|---|
| Value 1 | Speed 1 | Angle 1 | Flow value 1 |
| Value 2 | Speed 2 | Angle 2 | Flow value 2 |
| . . . | . . . | . . . | . . . |
| Value n | Speed n | Angle n | Flow value n |

If the system is to be designed as fail-safe the required positions of the actuators must be established in a fail-safe manner. This is done for example on the basis of two position sensors (angular position sensor, stroke sensor, rotational speed sensor, Hall sensor etc.). On the basis of the regulator 37 the flap 4 (with motorized adjustment) or the valve is adjusted to the point at which the signal 21 of the mass flow sensor 13 in the side duct 28 reaches the value stored in the memory for the requested throughflow. In accordance with a particular form of embodiment the rotational speed of the fan 3 is invariable. The throughflow 5 through duct 11 is exclusively adjusted via the further flap (with motorized adjustment) or via the further valve.

In the two forms of embodiment given here with regulation of air throughput 5 via the flap 4 (with motorized adjustment), the flap position 9 can also be recorded directly as a fixed value in the table. A second assignment for the amount of fuel 6 can however also be formed here. The assignment of the linearized scale of fuel throughput 6 to the linearized scale of air throughput 5 is defined via a factor as described above.

Parts of a closed-loop control device or of a method in accordance with the present disclosure can be realized as hardware, as a software module, which is executed by a computer unit, or on the basis of a Cloud computer, or on the basis of a combination of the aforementioned options. The software might comprise firmware, a hardware driver, which is executed within an operating system, or an application program. The present disclosure thus relates to a computer program product, which contains the features of this disclosure or carries out the required steps. In a realization as software the described functions can be stored as one or more commands on a computer-readable medium. A few examples of computer-readable media include random access memory (RAM), magnetic random access memory (MRAM), read only memory (ROM), flash memory, electronically programmable ROM (EPROM), electronically programmable and erasable ROM (EEPROM), registers of a computer unit, a hard disk, a removable storage unit, an optical memory, or any other suitable medium that can be accessed by a computer or by other IT devices and applications.

REFERENCE CHARACTERS

1 Burner
2 Heat consumer (heat exchanger)
3 Fan
4 Flap or valve (with motorized adjustment)
5 Throughflow (particle flow and/or mass flow) or flow through duct 11 (air throughput)
6 Fluid flow of a combustible fluid (fuel throughput)
7 8 Safety valve
9 Flap or valve (with motorized adjustment)
10 Waste gas flow, exhaust gas flow
11 Feed duct (air duct)
12 Connection point, Pitot probe
13 Mass flow sensor
14 Flow resistance element (diaphragm)
15 Throughflow or flow in the side duct
16 Closed-loop and/or open-loop control and/or monitoring device
17 Mixing device
18, 19, 20 Flow resistance elements (diaphragms)
21-26 Signal lines
27 Air inlet
28 Side duct
29 Bypass duct
30 Exhaust gas duct
31 Openings of the Pitot probe
32 Required value for regulation
33 Required-actual deviation
34 Measuring arrangement
35 Differentiation
36 Filter
37 Regulator, for example a PI(D) controller
38 Fuel feed duct

The invention claimed is:

1. A method for regulating a burner device with a mass flow sensor, a side duct of a feed duct of the burner device, the side duct including a first flow resistance element and a second flow resistance element arranged therein, and a bypass duct from the side duct, the bypass duct including a third flow restriction element mounted in series with the mass flow sensor in the bypass duct, a regulator, a first actuator, and a second actuator acting on the feed duct, an exhaust gas duct with a probe in the exhaust gas duct, and a λ regulator, the method comprising:

requesting a flow of a fluid through the feed duct;

adjusting a setting of the first actuator based on the requested flow;

measuring an actual flow of the fluid through the bypass duct using the mass flow sensor;

comparing the requested flow of the fluid through the feed duct to a corresponding flow of the fluid through the bypass duct; and controlling the second actuator as a function of the actual value of the flow of the fluid through the bypass duct and the corresponding flow of the fluid through the bypass duct;

generating a signal with the probe in the exhaust gas duct;

transferring the signal from the probe to the λ regulator;

determining a variable factor between the flow of a fuel through a fuel feed duct and the flow of a fluid through the feed duct as a function of the transferred signal;

assigning a flow of a fuel through the fuel feed duct to a flow of a fluid through the feed duct on the basis of the variable factor determined.

2. The method as claimed in claim 1, wherein the requested flow of the fluid through the feed duct has a corresponding unique value of the flow of the fluid through the side duct.

3. The method as claimed in claim 1, wherein controlling the second actuator includes generating a regulation signal for the second actuator on the basis of a proportional-integral regulator or a proportional-integral-derivative regulator.

4. The method as claimed in claim 1, wherein the second actuator comprises:

a fan arranged in the feed duct; and a drive for the fan with an adjustable rotational speed.

5. The method as claimed in claim 1, wherein the second actuator comprises a fan; and controlling the second actuator includes generating a regulation signal for the second actuator including a pulse-width-modulated signal or a converter signal with a frequency that corresponds to a rotational speed of the fan.

6. The method as claimed in claim 1, wherein the first actuator comprises:

a flap arranged in the feed duct; and a motorized adjustment for the flap.

7. The method as claimed in claim 1, wherein measuring an actual flow through the side duct comprises filtering a signal generated by the mass flow sensor.

8. The method as claimed in claim 1, wherein the fuel feed duct further comprises a safety shut-off valve for closing off the fuel feed duct, the method further comprising:

comparing the generated regulation signal against a threshold band including an upper threshold value or a lower threshold value;

generating a signal for switching off the burner device, if the generated regulation signal lies outside of the threshold band; and transmitting the generated signal to the safety shut-off valve.

9. The method as claimed in claim 1, wherein the fuel feed duct further comprises a safety shut-off valve for closing off the fuel feed duct, the method further comprising:

comparing the actual value of the flow through the side duct with an upper threshold value and/or with a lower threshold value, generating a signal for switching off the burner device, if the actual value of the flow through the side duct lies above the upper threshold value or below the lower threshold value;

transmitting the generated signal to the safety shut-off valve.

10. The method as claimed in claim 1, wherein the requested flow through the feed duct is assigned to a setting of the first actuator on the basis of a predetermined table, in which values of the requested flow through the feed duct are assigned to settings of the first actuator.

11. The method as claimed in claim 1, wherein the burner device additionally comprises a fuel actuator acting on the fuel feed duct, the method further comprising:

requesting a flow of a fuel through the fuel feed duct;

correlating the requested flow through the fuel feed duct to a setting of the fuel actuator;

wherein the flow through the fuel feed duct is assigned to a setting of the fuel actuator on the basis of a table, in which values of the requested flow of a fuel through the fuel feed duct are assigned to values of the settings of the at least one fuel actuator;

transmitting a fuel signal to the fuel actuator based on the correlated setting of the fuel actuator; and setting the fuel actuator based on the fuel signal.

12. The method as claimed in claim 11, the method further comprising assigning a flow through the fuel feed duct to a flow through the feed duct on the basis of a constant factor between the flow through the fuel feed duct and a flow of a fluid through the feed duct.

13. The method as claimed in claim 1, the method further comprising calculating a power generated by the burner device on the basis of the required value of the regulator and/or the value of the requested throughflow through the feed duct.

14. A method for regulating a burner device, wherein the burner device includes a feed duct, a side duct branching from the feed duct, a bypass duct branching from the side duct, and a mass flow sensor arranged in the bypass duct, the method comprising:

setting a first actuator to deliver a requested mass flow of a first fluid through the feed duct;

measuring an actual mass flow of the first fluid through the bypass duct using the mass flow sensor; and adjusting a setpoint for a second actuator to modify a mass flow of the first fluid through the feed duct based at least in part on the measure actual mass flow of the first fluid through the bypass duct;

generating a signal with a probe in an exhaust gas duct;

transferring the signal from the probe to a λ regulator;

determining a variable factor between the flow of a fuel through a fuel feed duct and the flow of a fluid through the feed duct as a function of the transferred signal;

assigning a flow of a fuel through the fuel feed duct to a flow of a fluid through the feed duct on the basis of the variable factor determined.

15. A method for regulating a burner device having a feed duct with a regulator, a first actuator and a second actuator mounted in series in the feed duct, a mass flow sensor mounted in a bypass duct from a side duct off of the feed duct, the side duct including a first flow resistance element and a second flow resistance element, the bypass duct including a third flow resistance element mounted in series with the mass flow sensor within the bypass duct, the method comprising:

requesting a flow of a fluid through the feed duct;

adjusting a setting of the first actuator based on the requested flow;

measuring an actual flow of the fluid through the bypass duct downstream of the third flow restriction element using the mass flow sensor;

comparing the requested flow of the fluid through the feed duct to a corresponding flow of the fluid through the bypass duct; and controlling the second actuator as a function of the actual value of the flow of the fluid through the bypass duct and the corresponding flow of the fluid through the bypass duct;

generating a signal with a probe in an exhaust gas duct;

transferring the signal from the probe to a λ regulator;

determining a variable factor between the flow of a fuel through a fuel feed duct and the flow of a fluid through the feed duct as a function of the transferred signal;

assigning a flow of a fuel through the fuel feed duct to a flow of a fluid through the feed duct on the basis of the variable factor determined.

* * * * *